US007156079B2

(12) United States Patent
Kamiyama et al.

(10) Patent No.: US 7,156,079 B2
(45) Date of Patent: Jan. 2, 2007

(54) DIESEL ENGINE

(75) Inventors: Toshio Kamiyama, Osaka (JP); Katsuyuki Shiota, Osaka (JP); Yasuhiro Kanazu, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 11/219,877

(22) Filed: Sep. 7, 2005

(65) Prior Publication Data

US 2006/0048755 A1 Mar. 9, 2006

Related U.S. Application Data

(63) Continuation of application No. PCT/JP2004/001666, filed on Feb. 16, 2004.

(30) Foreign Application Priority Data

Mar. 11, 2003 (JP) ..... 2003-65338

(51) Int. Cl.
*F02M 37/04* (2006.01)

(52) U.S. Cl. ..... 123/508; 123/509

(58) Field of Classification Search ..... 123/509, 123/90.5, 90.48, 508
See application file for complete search history.

(56) References Cited

U.S. PATENT DOCUMENTS 3,668,945 A * 6/1972 Hofmann ..... 74/569
4,721,442 A * 1/1988 Tanaka ..... 417/499
4,829,646 A * 5/1989 Cigolotti et al. ..... 29/888.01
4,976,994 A * 12/1990 Matson ..... 427/230
5,390,642 A * 2/1995 Thoma ..... 123/508
5,419,298 A * 5/1995 Nolte et al. ..... 123/508
5,454,353 A * 10/1995 Elendt et al. ..... 123/90.16
5,564,395 A * 10/1996 Moser et al. ..... 123/509
5,975,038 A * 11/1999 Fischer et al. ..... 123/90.55
5,979,416 A * 11/1999 Berger ..... 123/509
6,895,942 B1 * 5/2005 Iitaka et al. ..... 123/509
2006/0016406 A1 * 1/2006 Geyer ..... 123/90.5
2006/0112915 A1 * 6/2006 Kreil et al. ..... 123/90.5

FOREIGN PATENT DOCUMENTS

JP 58 113867 8/1983
JP 6 159192 6/1994
JP 7 208120 8/1995

OTHER PUBLICATIONS

International Search Report for International Application No. PCT/JP2004/001666; Mailed May 11, 2004.

* cited by examiner

*Primary Examiner*—Thomas Moulis
(74) *Attorney, Agent, or Firm*—Sterne, Kessler, Goldstein & Fox P.L.L.C.

(57) ABSTRACT

A diesel engine 1 of the present invention comprises: a camshaft 13 with a cam 21; a fuel injection pump 12 having a plunger 84; a tappet for driving the plunger 84; and a slide portion 2*b*. The tappet includes a roller 80 and a roller tappet 82. The roller 80 serves as a rotor which abuts against the cam 21 so as to drive the fuel injection pump 12, and a roller tappet 82 serves as a support portion for supporting the rotor. The slide portion 2*b* slidably fits to the support portion. The roller tappet 82 has a tappet guide serving as a projection for restriction of rotation, and the slide portion 2*b* has a guide groove 92 into which the projection is fitted. Therefore, the rotor and the cam abutting against the rotor can be prevented from abrasion so as to maintain high accuracy in controlling slide stroke of the plunger.

5 Claims, 4 Drawing Sheets

DIESEL ENGINE

CROSS-REFERENCE TO RELATED APPLICATION

The present application is a Continuation of PCT Application No. PCT/JP2004/001666, filed Feb. 16, 2004, which is incorporated in its entirety herein by reference thereto.

BACKGROUND OF THE INVENTION

1. Field of the Invention

The invention relates to technology of a diesel engine with a fuel injection pump whose crankshaft drives a camshaft on which a cam is provided to abut against a rotor for driving a fuel injection pump. Especially, the invention relates to a configuration of a fuel injection pump for delivering fuel by a plunger slid by rotation of a camshaft.

2. Background Art

Conventionally, there is a well-known diesel engine having a fuel injection pump which delivers fuel by sliding a plunger interlocking with a rotor (roller) abutting against a cam provided on a camshaft driven by a crankshaft.

Further, as disclosed in Japanese Laid Open Gazette No. Hei 7-208120, there is a well-known rotor support member (roller tappet) slidably fitted to a guide formed or fixed on a cylinder block so as to pivotally support the rotor.

The typical rotor support member of the conventional diesel engine is substantially circular in section such as to prevent abrasion during the sliding and to reduce energy loss.

The rotor support member has a support shaft for supporting the rotor, and it is desired to be essentially disposed substantially in parallel to an axial direction of the camshaft. However, when the rotor support member rotates along the peripheral surface thereof in the periphery direction, deviation of the support shaft in the axial direction may occur so as to cause abrasion of the rotor and the cam, and to make it difficult to accurately control the slide stroke of the plunger (and to thereby reduce energy loss).

In consideration of this situation, the present invention provides a diesel engine in which a rotor provided on a plunger of a fuel injection pump can slide while keeping its preset attitude relative to the cam and camshaft.

SUMMARY OF THE INVENTION

According to the invention, a diesel engine comprises: a camshaft with a cam; a fuel injection pump having a plunger; a tappet for driving the plunger; and a slide portion. The tappet includes a rotor which abuts against the cam so as to drive the fuel injection pump, and a support portion for supporting the rotor. The slide portion slidably fits to the support portion. One of the support portion and the slide portion has a projection for restriction of rotation, and the other has a guide groove into which the projection is fitted. Due to the construction, even if the support portion slides in the slide portion according to rotation of the camshaft of camshaft, the support portion is prevented from rotating in the peripheral direction in the slide portion, so that the axial (longitudinal) direction of the rotor supported by the support portion is constantly disposed substantially in parallel to the axial (longitudinal) direction of the camshaft. Consequently, the rotor and the cam abutting against the rotor are prevented from abrasion so as to maintain high accuracy in controlling slide stroke of the plunger. Such a simple construction is provided for preventing the support portion for supporting the rotor from rotating in the peripheral direction so as to save costs.

Preferably, according to the present invention, the projection projects along the rotation direction of the camshaft or along the direction opposite to the rotational direction of the camshaft. Due to this construction, the center of gravity of the supporting portion for supporting the rotor is lowered so as to restrict rotation of the support portion and to further stabilize the slide of support portion.

Preferably, according to the present invention, the projection is disposed between the rotor and biasing means for biasing the rotor toward the camshaft. In this way, a space above and sideward from the rotor is used to have the projection projecting sideward of the support portion. Therefore, the support portion can be compact, prevent the projection from interfering with the space for arranging the rotor, and smoothly rotate the rotor.

Preferably according to the present invention, the projection is disposed between the rotor and biasing means for biasing the rotor toward the camshaft, and the projection projects along the rotational direction of the camshaft or along the direction opposite to the rotational direction of the camshaft. Due to this construction, the center of gravity of the supporting portion for supporting the rotor is lowered so as to restrict rotation of the support portion and to further stabilize the slide of support portion. Further, a space above and sideward from the rotor is used to have the projection projecting sideward of the support portion. Therefore, the support portion can be compact, prevent the projection from interfering with the space for arranging the rotor, and smoothly rotate the rotor.

Preferably, according to the present invention, the projection is detachably fitted to the support portion or the slide portion. Accordingly, the projection can be easily exchanged so as to improve facility of maintenance.

Preferably, according to the present invention, the projection is made of a rivet pin, a screw or a bolt. Such goods on the market can be used so as to reduce costs, to be easily exchanged and to improve facility of maintenance.

Preferably, according to the present invention, the diesel engine further comprises a cylinder block. The cylinder block includes an opening for inserting the fuel injection pump into the cylinder block, and a tap disposed adjacent to the opening and formed so as not to open to the interior space of the cylinder block. The tap is used for fitting the fuel injection pump into the opening. Due to such a bladder-shaped tap, the interior of the cylinder block can be prevented from dust and excellently air-tightened so as to prevent abrasion and damage of component parts in the engine.

According to the present invention, a diesel engine comprises: a camshaft with a cam; a fuel injection pump having a plunger; a tappet for driving the plunger; and a cylinder block. The tappet has a rotor which abuts against the cam so as to drive the fuel injection pump. The cylinder block includes an opening for inserting the fuel injection pump into the cylinder block, and a tap disposed adjacent to the opening and formed so as not to open to the interior space of the cylinder block. The tap is used for fitting the fuel injection pump into the opening. Due to such a bladder-shaped tap, the interior of the cylinder block can be prevented from dust and excellently air-tightened so as to prevent abrasion and damage of component parts in the engine.

BEST MODE FOR CARRYING OUT THE INVENTION

Figure 1:
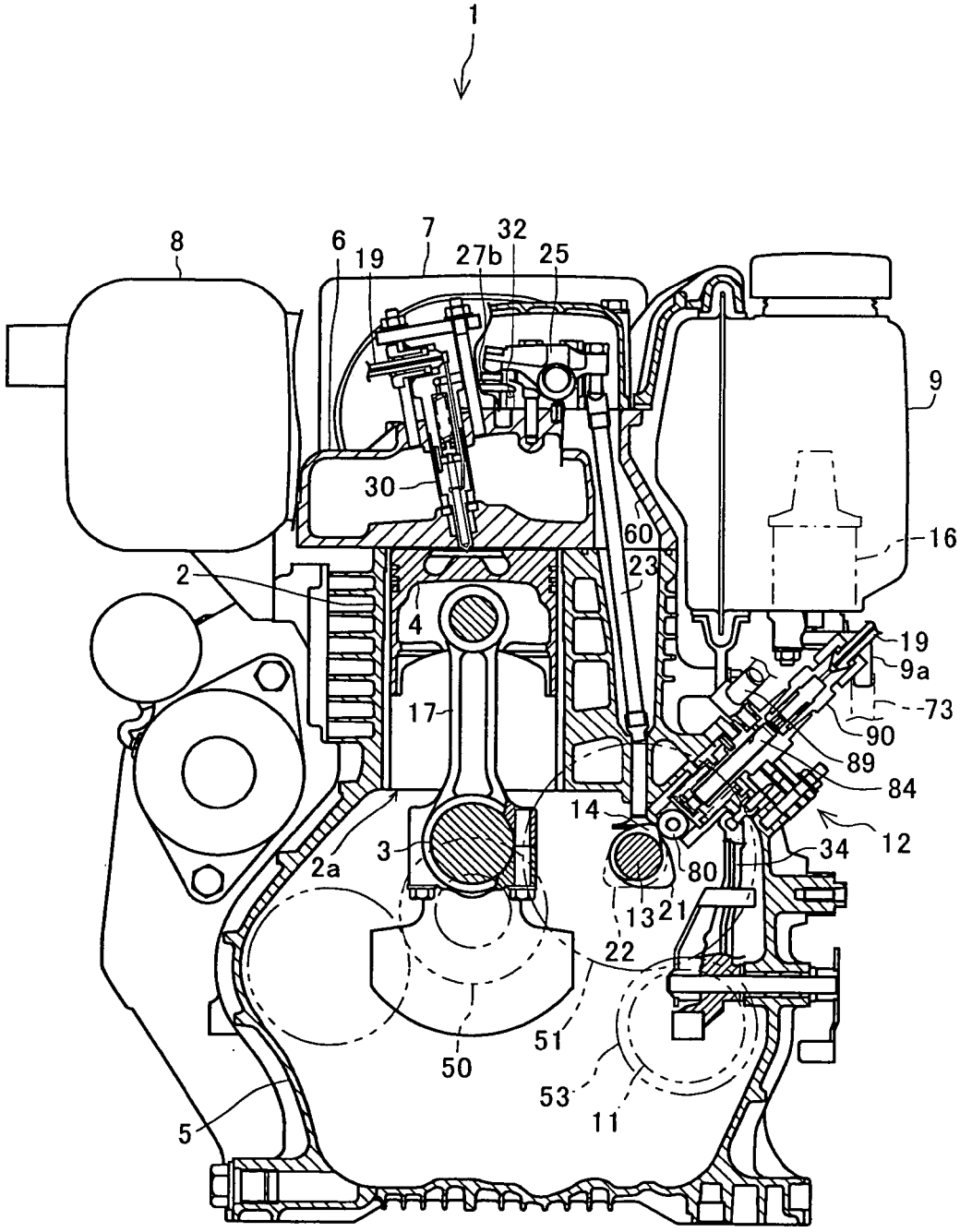
FIG. 1 is a sectional front view of a diesel engine according to an embodiment of the present invention.
Figure 2:
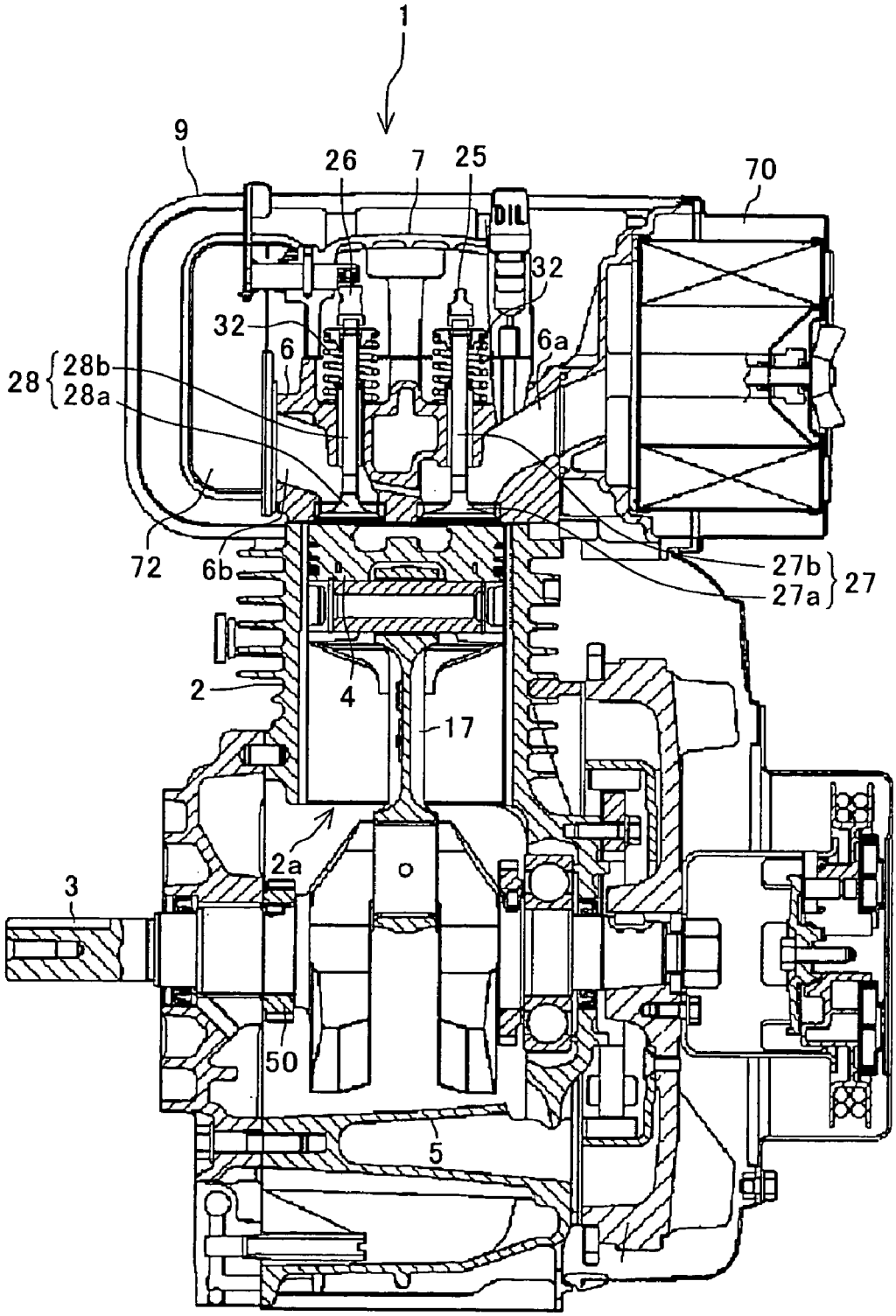
FIG. 2 is a sectional side view of the diesel engine according to the embodiment of the present invention.
Figure 3:
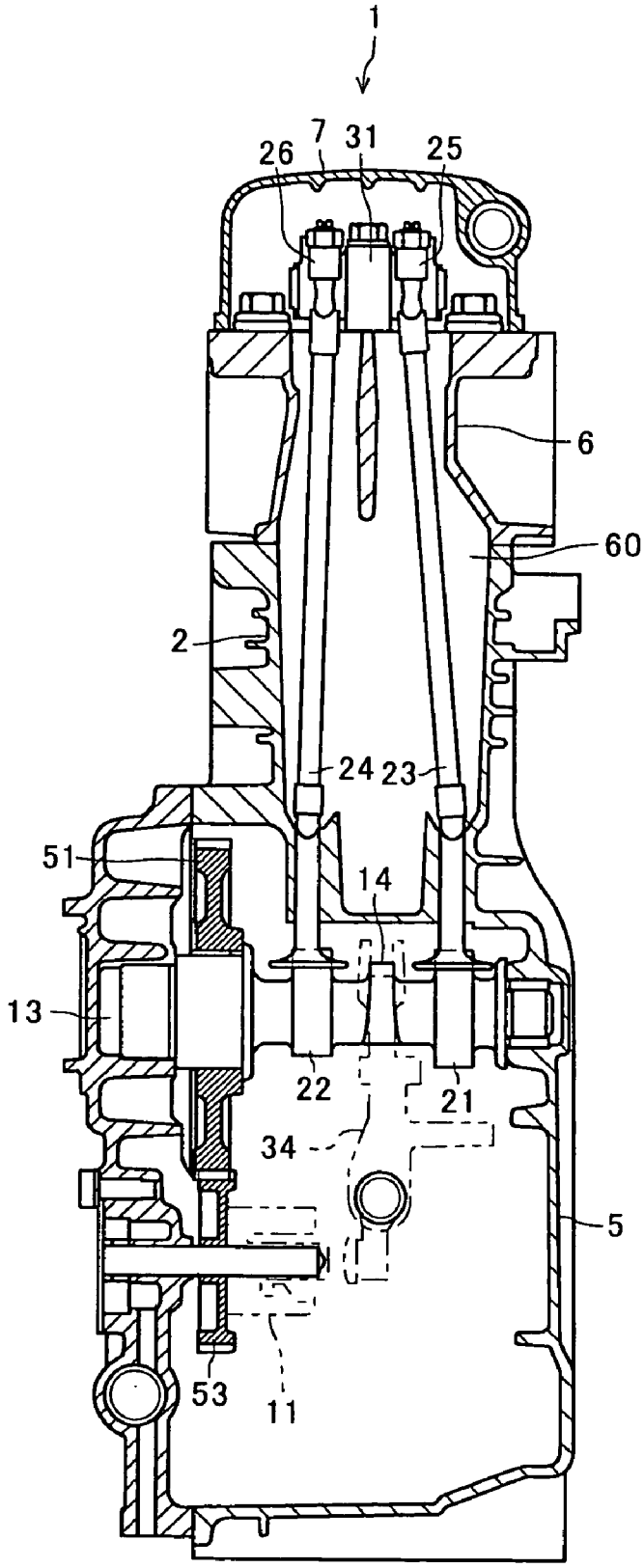
FIG. 3 is another sectional side view of the diesel engine according to the embodiment of the present invention.

Referring to FIGS. 1 to 3, entire configuration of an engine of the invention will be described.

As shown in FIG. 1, an engine 1 has a main body, whose upper portion serves as a cylinder block 2, and whose lower portion serves as a crankcase 5. Cylinder block 2 is formed in an inner center portion thereof with a vertical cylinder 2*a* having a piston 4 therein. A crankshaft 3 is journalled in crankcase 5, and connected to piston 4 through a connecting rod 17. A cylinder head 6 covers the top of cylinder block 2, and a bonnet 7 covers the top of cylinder head 6 so as to ensure a rocker arm chamber therein. A muffler 8 is disposed on one side (in FIG. 1, left side) of bonnet 7, and a fuel tank 9 is disposed on the other side (in FIG. 1, right side) of bonnet 7.

A governor 11 is disposed in crankcase 5 below cylinder block 2. A fuel injection pump 12 is disposed above governor 11. A cam gear 51 is provided on a camshaft 13 and meshes with a gear 50 provided on crankshaft 3. A pump drive cam 14 is formed on an intermediate portion of camshaft 13 so as to abut against a roller 80 serving as a rotor provided on one end of a plunger 84 of fuel injection pump 12.

Accordingly, by rotating crankshaft 3, camshaft 13 also rotates for sliding plunger 84 of fuel injection pump 12 so as to absorb fuel from fuel tank 9 and to deliver a certain quantity of fuel via a high-pressure pipe 19 to a fuel injection nozzle 30. A control lever 34 is rotated so as to adjust the quantity of fuel delivered from fuel injection pump 12. Control lever 34 is operatively connected to governor 11. Governor 11 has a governor gear 53 meshing with cam gear 51. When governor gear 2 receives torque, governor 11 actuates. A rotary shaft of governor gear 53 also drives a pump for circulating lube in crankcase 5.

As shown in FIG. 3, an air suction cam 21 and an air exhaust cam 22 are formed on camshaft 13 so as to be disposed opposite to each other with respect to pump drive cam 14. An air suction pushrod 23 abuts at the bottom end thereof against air suction cam 21, and an air exhaust pushrod 24 abuts at the bottom end thereof against air exhaust cam 22. Air suction pushrod 23 an air exhaust pushrod 24 are disposed in a pushrod chamber 60 enclosed by cylinder block 2, cylinder head 6 and bonnet 7.

As shown in FIGS. 1 and 2, a top of air suction pushrod 23 abuts against one side bottom end of an air suction rocker arm 25, and a top of an air suction valve 27 abuts against the other side bottom end of air suction rocker arm 25. A top of air exhaust pushrod 24 abuts against one side bottom end of an air exhaust rocker arm 26, and a top of an air exhaust valve 28 abuts against the other side bottom end of air exhaust rocker arm 26. A pair of support members 31 are fixed on cylinder head 6 so as to rotatably support respective rocker arms 25 and 26, and disposed fore-and-aft opposite to each other with respect to a fuel injection nozzle 30.

As shown in FIGS. 2 and 3, air suction valve 27 and air exhaust valve 28 are disposed above piston 4.

Air suction valve 27 includes a body serving as a valve rod 27*b*, whose bottom end serves as a valve head 27*a*. Valve rod 27*b* upwardly penetrates cylinder block 6 so as to project into bonnet 7. By axial sliding of air suction valve 27, valve head 27*a* is selectively fitted or separated on and from a valve seat formed on a bottom surface of cylinder head 6 so as to selectively open or shut cylinder 2*a* formed in cylinder block 2 to and from an air suction port 6*a* formed in cylinder head 6. Air suction valve 27 is upwardly biased by a spring 32 wounded around valve rod 27*b* in bonnet 7 so as to be closed.

Air exhaust valve 28 includes a body serving as a valve rod 28*b*, whose bottom end serves as a valve head 28*a*. Valve rod 28*b* upwardly penetrates cylinder block 6 so as to project into bonnet 7. By axial sliding of air exhaust valve 28, valve head 28*a* is selectively fitted or separated on and from a valve seat formed on a bottom surface of cylinder head 6 so as to selectively open or shut cylinder 2*a* formed in cylinder block 2 to and from an air exhaust port 6*b* formed in cylinder head 6. Air exhaust valve 28 is upwardly biased by a spring 32 wounded around valve rod 28*b* in bonnet 7 so as to be closed.

Air suction port 6*a* is opened to air cleaner 70. Air exhaust port 6*b* is opened to muffler 8 via an air exhaust manifold 72.

A configuration for supplying fuel into fuel injection pump 12 will be described.

As shown in FIG. 1, fuel tank 9 is disposed on an upper portion of the main body of engine 1. Fuel tank 9 is provided at a lower portion thereof with a fuel outlet 9*a*. A hose 73 is connected at one end thereof to fuel outlet 9*a*, and at the other end thereof to a fuel suction port 89 of fuel injection pump 12. A fuel delivery port 90 of fuel injection pump 12 is opened to fuel injection nozzle 30 via high-pressure pipe 19.

Figure 4:
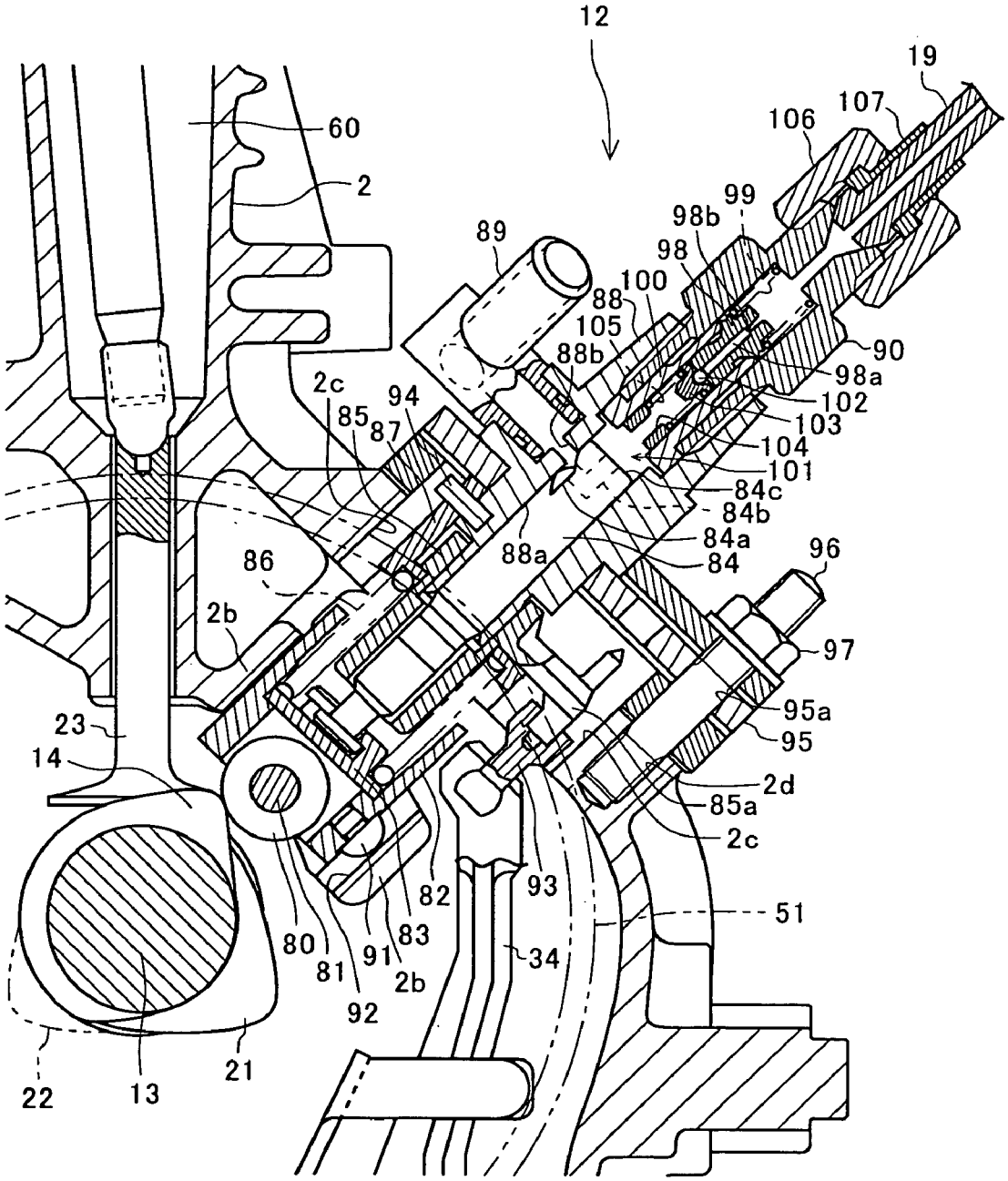
FIG. 4 is a sectional view of a fuel injection pump.

Referring to FIGS. 1 and 4, fuel injection pump 12 in the diesel engine of the invention will be detailed. In addition to fuel injection pump 12, the present invention is widely adaptable to other fuel injection pumps each of which has a rotor for reciprocally sliding a plunger.

As shown in FIG. 4, fuel injection pump 12 of the diesel engine of the invention mainly comprises a roller 80 serving as the rotor, a roller pin 81, a roller tappet 82 serving as the rotor support member, a lower spring retainer 83, a plunger 84, a plunger lever 85, a plunger spring 86, an upper spring retainer 87, a plunger barrel 88, fuel suction port 89 and fuel delivery port 90.

Roller 80 serves as the rotatable rotor abutting against pump drive cam 14 formed on camshaft 13. Roller 80 is freely rotatably provided on roller pin 81. Roller pin 81 is pivotally supported at opposite ends thereof by roller tappet 82.

Roller tappet 82 is a substantially cylindrical member. Roller 80 is pivoted via roller pin 81 at a bottom portion of roller tappet 82. A bottom of roller 80 projects downward from the bottom of roller tappet 82 so as to be prevented from interfering with pump drive cam 14. Roller tappet 82 is slidably fitted to a slide portion 2*b* formed in cylinder block 2.

A tappet guide 91 is fitted onto the outer peripheral surface of roller tappet 82 so as to projects at a head thereof outward from the outer peripheral surface of roller tappet 82 toward slid portion 2*b*.

On the other hand, a guide groove 92 is formed at slide portion 2*b* so as to correspond to tappet guide 91. The longitudinal direction of guide groove 92 substantially coincides to the slide direction of roller tappet 82, i.e., the slide (axial) direction of plunger 84. The width of guide groove 92 is substantially equal to the width of the head of tappet guide 91.

In this way, when roller tappet 82 slides in slide portion 2*b*, tappet guide 91 fits into guide groove 92 so as to move along guide groove 92, thereby preventing roller tappet 82 from rotating in the peripheral direction thereof in slide portion 2*b*.

Accordingly, even when roller tappet 82 slides in slide portion 2*b* by rotating camshaft 13, the axial (longitudinal) direction of roller pin 81 serving as a rotary shaft supporting roller 80 is constantly kept substantially in parallel to the axial (longitudinal) direction of camshaft 13 so as to smoothly rotate roller 80, thereby preventing eccentric abrasion of roller 80 serving as the rotor and pump drive cam 14, and maintaining high-accurate control of slide stroke of plunger 84. Prevention of peripherally rotation of roller tappet 92 can be ensured by such a simple structure, thereby reducing costs.

Lower spring retainer 83 is fitted in roller tappet 82. Plunger spring 86 serves as means for biasing roller tappet 82 so as to press roller 80 against pump drive cam 14. Lower spring retainer 83 serves as a retainer for retaining plunger spring 86 on the roller tappet 82 side, and also serves as an engaging member for engaging the lower end portion of plunger 84 (toward the roller tappet) with roller tappet 82.

Here, tappet guide 91 is disposed between lower spring retainer 83 and roller pin 81 serving as the rotary shaft of roller 80 in the slide direction of plunger 84 (i.e., the slide direction of roller tappet 82).

Due to this structure, tappet guide 91 serving as a projection projecting sideward from roller tappet 82 can be disposed in the space upward and sideward from roller 80 serving as the rotor, thereby preventing tappet guide 91 from interfering with arrangement and rotation of roller 80, and compacting roller tappet 82.

In fuel injection pump 12 of the present embodiment, the slide direction of plunger 84 (i.e., the slide direction of the roller tappet) is slanted to some degree from the vertical line so as to substantially coincide to the rotational direction of camshaft 13 at the position where roller 80 abuts against pump drive cam 14 formed on camshaft 13.

Further, tappet guide 91 and guide groove 92 are disposed on a side of the slide shaft of roller tappet 82 toward slanted fuel injection pump 12 (i.e., ahead side in the rotational direction of camshaft 13). In this regard, tappet guide 91 is formed as a projection projecting along the rotational direction (or the opposite rotational direction) of camshaft 13.

Due to this construction, roller tappet 82 has a low center of gravity by the weight of lowered tappet guide 91 so that rotation of roller tappet 82 in the peripheral direction is restricted, thereby further stabilizing the slide of roller tappet 82.

Plunger 84 is a substantially circularly columnar member. An upper half portion of plunger 84 toward its discharge port is air-tightly and slidably fitted to plunger barrel 88, and a lower half portion of plunger 84 toward the roller tappet is splined so as to slidably spline-fitted onto a plunger lever 85.

Plunger lever 85 is rotatably fitted onto the lower end portion of plunger barrel 88 at an upper half portion thereof on the discharge port side, and slidably spline-fitted onto plunger 84 at a lower half portion thereof on the roller tappet side. Plunger lever 85 is formed with a sideward lever portion 85*a* connected to control lever 34 via a lever pin 93 fixed on lever portion 85*a*.

Accordingly, due to rotation of control lever 34, plunger 84 spline-fitted to plunger lever 85 can be rotated in the peripheral direction in plunger barrel 88.

Upper spring retainer 87 is not-peripherally rotatably engaged to plunger barrel 88 via a pin 94. Upper spring retainer 87 serves as a member for retaining plunger spring 86 on the side toward plunger barrel 88, and also serves as a member for peripherally rotatably retaining plunger lever 85 so as to prevent plunger barrel 85 from falling toward roller tappet 82.

Plunger barrel 88 is a member serving as a barrel portion of fuel injection pump 12, and has plunger 84 air-tightly and slidably fitted therein.

A lower half portion of fuel injection pump 12 (in this embodiment, which includes roller 80, roller pin 81, roller tappet 82, lower spring retainer 83, the lower half portion of plunger 84, plunger lever 85, plunger spring 86, upper spring retainer 87, the lower half portion of plunger barrel 88) is inserted into cylinder block 2 through an opening 2*c* of cylinder block 2, and fastened to cylinder block 2 by a fastener 95 fitted on the outer peripheral surface of plunger barrel 88 via an air-sealing sheet or the like.

In this situation, a bolt hole 95*a* bored through fastener 95 substantially coincides to a bladder-shaped tap 2*d* formed in an outer surface portion of cylinder block 2 adjacent to opening 2*c*, so as to pass a bolt 96 with a nut 97 to fasten cylinder block 2 to fuel injection pump 12. The depth of bladder-shaped tap 2*d* is set so that tap 2*d* does not penetrate the inner periphery surface of cylinder block 2.

In this way, cylinder block 2 has opening 2*c* for inserting fuel injection pump 12 into cylinder block 2, and has bladder-shaped tap 2*d* which is not opened to the interior space of cylinder block 2, so as to be used for fitting fuel injection pump 12 into opening 2*c*. Due to bladder-shaped tap 2*d*, the interior of cylinder block 2 is protected from dust and the like, and advantageously air-tightened, thereby preventing component parts in engine 1 from being abraded, damaged or subjected to other problems caused by entrance of dust and the like into cylinder block.

Fuel suction port 89 is disposed on a side surface of plunger barrel 88 outside cylinder block 2. Plunger barrel 88 is provided with a connection port 88*b* between fuel suction port 89 and a side surface of 88*a* of plunger barrel 88 air-tightly and slidably fitting to plunger 84. Plunger 84 is formed on the outer peripheral surface thereof with a screw-shaped lead 84*a*, and bored from the upper surface thereof with an axial fuel discharge hole 84*b* connected to lead 84*a*.

A delivery valve 98 is disposed in fuel delivery port 90. Delivery valve 98 is biased downward (toward the roller tappet) by a delivery valve spring 99, and adapted to be fitted onto an upper end portion of a delivery valve slider 100 so as to shut a compression chamber 101 from high-pressure pipe 19.

A backflow hole 98*a* penetrates delivery valve 98 in the up-and-down direction (between the compression chamber 101 side and the high-pressure pipe 19 side). Backflow hole 98*a* is formed at an intermediate portion thereof into an orifice 98*b*.

A ball 102 is disposed in a lower end portion of backflow hole 98*a*, and a backflow valve spring 105 is interposed between a ball receiver 103 and a spring retainer 104. Backflow valve spring 105 presses ball 102 through ball receiver 103 onto the lower end portion of backflow hole 98*a* so as to shut compression chamber 101 from high-pressure pipe 19.

High-pressure pipe 19 is connected to the upper end portion of delivery port 90 via a connector 106 and a seal 107.

In the present embodiment, tappet guide 91 is a protrusive member separated from roller tappet 92 serving as the supporter for the rotor. However, this configuration is not limitative. Alternatively, tappet guide 91 may be integrally formed of roller tappet 92. Further alternatively, a projection formed toward slide portion 2*b* and a guide groove formed on roller tappet 82 may have the same effect.

In this embodiment, only one couple of tappet guide 91 serving as the projection and guide groove 92 are provided. Alternatively, two couples of them may be provided. Tappet guide 91 may be made of a rivet pin, a screw, a bolt, or other goods on the market, which is inexpensive and can be easily exchanged so as to facilitate maintenance.

Further, lower spring retainer 83, which is separated from roller tappet 82 in the present embodiment, may be integrally formed with roller tappet 82.

Description will now be given of a fuel injection cycle of fuel injection pump 12.

When plunger 84 reaches the lowest slide position (most close to the camshaft), an upper surface 84*c* of plunger 84 is disposed lower than connection port 88*b* so as to introduce fuel from fuel tank 9 into compression chamber 101 via fuel suction port 89 and connection port 88*b*.

By rotating camshaft 13, plunger 84 slides upward (toward the compression chamber) so that the outer peripheral surface of plunger 84 shuts compression chamber 101 from connection port 88*b*, thereby compressing fuel in compression chamber 101 and increase the pressure in compression chamber 101.

When the pressure in compression chamber 101 becomes equal to or larger than a predetermined value, delivery valve 98 slides upward against the biasing force of delivery valve spring 99 apart from the upper end portion of delivery valve slider 100 so as to fluidly connect compression chamber 101 to high-pressure pipe 19, and the compressed fuel is charged into fuel injection nozzle 30 via high-pressure pipe 19.

By further upward slide of plunger 84, lead 84*a* formed on the outer peripheral surface of plunger 84 becomes open to connection port 88*b*, thereby fluidly connecting suction port 89 to compression chamber 101 via lead 84*a* and fuel discharge hole 84*b*.

Accordingly, high-pressurized fuel in compression chamber 101 backflows into fuel suction portion 89 so as to reduce the pressure in compression chamber 101, whereby delivery valve 98 is re-closed by the force of delivery valve spring 99 (i.e., delivery valve 98 is fitted onto the upper end portion of delivery valve slider 100) so as to stop the delivery of fuel to fuel injection nozzle 30.

At this time, plunger 84 can be rotated in the peripheral direction in plunger barrel 88 by rotating control lever 34. By rotating plunger 84 in plunger barrel 88, the stroke of plunger 84 for opening lead 84*a* formed on the outer peripheral surface of plunger 84 to connection port 88*b* during the upward slide of plunger 84 is changed, thereby changing the quantity of fuel charged into high-pressure pipe 19.

When plunger 84 slides downward, the outer peripheral surface of plunger 84 shuts compression chamber 101 from connection port 88*b* again so as to reduce the pressure in compression chamber 101. At this time, due to the difference of pressure between high-pressure pipe 19 and compression chamber 101, ball 102 and ball receiver 103 slides downward against the biasing force of backflow valve spring 105 so that excessive fluid in high-pressure pipe 19 backflows toward compression chamber 101. When the pressure in high-pressure pipe 19 becomes equal to or lower than the predetermined value, ball 102 and ball receiver 103 slides upward by the biasing force of backflow valve spring 105 so as to shut compression chamber 101 from high-pressure pipe 19.

When plunger 84 slides further downward and upper surface 84*c* of plunger 84 reaches a position lower than connection port 88*b*, fuel from fuel tank 9 is introduced from suction port 89 into compression chamber 101 via connection port 88*b*.

Such a cycle is repeated so as to charge fluid into fuel injection nozzle 30.

INDUSTRIAL APPLICABILITY

The diesel engine of the present invention is widely applicable as a diesel engine whose crankshaft drives a camshaft on which a cam is provided to abut against a rotor for driving a fuel injection pump.

The invention claimed is:

1. A diesel engine comprising:

a camshaft with a cam;

a fuel injection pump having a plunger having a vertically slanted axis;

a tappet disposed at a lower axial end of the plunger so as to drive the plunger, the tappet including a rotor which abuts against the cam, a support portion supporting the rotor being slidable along the vertically slanted axis of the plunger, wherein the support portion has upper and lower ends extended along the vertically slanted axis of the plunger when viewed along an axis of the camshaft, and a projection projecting downward from the lower end of the support portion along the rotation direction of the camshaft or along the direction opposite to the rotation direction of the camshaft; and a slide guide portion for guiding the slide of the support portion of the tappet, the slide portion including a guide hole having upper and lower ends extended along the vertically slanted axis of the plunger when viewed along the axis of the camshaft, wherein the support portion of the tappet is inserted into the guide hole so that the upper and lower ends of the support portion are slidably fitted onto the respective upper and lower ends of the guide hole, and a guide groove formed along the lower end of the guide hole, the guide groove having an end extended alone the vertically slanted axis of the plunger when viewed along the axis of the camshaft, wherein the projection projecting from the lower end of the support portion of the tappet is inserted into the guide groove and slidably fitted onto the end of the guide groove so as to restrict rotation of the support portion.

2. The diesel engine according to claim 1, further comprising:

biasing means for biasing the rotor toward the camshaft, wherein the projection is disposed between the rotor and the biasing means.

3. The diesel engine according to claim 1, wherein the projection is detachably fitted to the support portion.

4. The diesel engine according to claim 1, wherein the projection is made of a rivet pin, a screw or a bolt.

5. The diesel engine according to claim 1, further comprising:

a cylinder block, the cylinder block including an opening for inserting the fuel injection pump into the cylinder block, and a tap disposed adjacent to the opening and formed so as not to open to the interior space of the cylinder block, wherein the tap is used for fitting the fuel injection pump into the opening.

* * * * *

UNITED STATES PATENT AND TRADEMARK OFFICE

CERTIFICATE OF CORRECTION

PATENT NO. : 7,156,079 B2
APPLICATION NO. : 11/219877
DATED : January 2, 2007
INVENTOR(S) : Kamiyama et al.

It is certified that error appears in the above-identified patent and that said Letters Patent is hereby corrected as shown below:

In column 8, in claim 1, line 39, “alone” should appear as --along--.

Signed and Sealed this

Twenty-sixth Day of August, 2008

JON W. DUDAS
*Director of the United States Patent and Trademark Office*